US011980292B1

(12) United States Patent
Wang

(10) Patent No.: US 11,980,292 B1
(45) Date of Patent: May 14, 2024

(54) SWINGABLE BRACKET FOR FURNITURE

(71) Applicant: Shenzhen Shuangheyi Technology Industrial Co., Ltd., Shenzhen (CN)

(72) Inventor: Lili Wang, Shenzhen (CN)

( * ) Notice: Subject to any disclaimer, the term of this patent is extended or adjusted under 35 U.S.C. 154(b) by 0 days.

(21) Appl. No.: 18/494,675

(22) Filed: Oct. 25, 2023

(30) Foreign Application Priority Data

Sep. 19, 2023 (CN) ..... 202311214974.5

(51) Int. Cl.

| | |
|---|---|
| ***A47C 4/28*** | (2006.01) |
| ***A47C 1/024*** | (2006.01) |
| ***A47C 1/032*** | (2006.01) |
| ***A47C 7/14*** | (2006.01) |

(52) U.S. Cl.
CPC ..... *A47C 1/024* (2013.01); *A47C 1/03261* (2013.01); *A47C 4/28* (2013.01); *A47C 4/286* (2013.01); *A47C 7/14* (2013.01)

(58) Field of Classification Search
CPC ..... A47C 4/28; A47C 4/286
See application file for complete search history.

(56) References Cited

U.S. PATENT DOCUMENTS

| | | | | |
|---|---|---|---|---|
| 9,854,914 | B2 * | 1/2018 | Yoo | A47C 4/286 |
| 10,010,179 | B1 * | 7/2018 | Stump | A47C 4/44 |
| 11,439,238 | B1 * | 9/2022 | Wang | A47C 4/44 |
| 11,700,943 | B1 * | 7/2023 | Wang | A47C 4/286 297/16.2 |
| 11,844,439 | B1 * | 12/2023 | Wang | A47C 3/40 |
| 11,864,660 | B1 * | 1/2024 | Wang | A47C 4/286 |
| 11,871,848 | B1 * | 1/2024 | Wang | A47C 1/03261 |
| 2022/0386779 | A1 * | 12/2022 | Garcia | A47C 4/286 |
| 2023/0023969 | A1 * | 1/2023 | Zhu | A47C 4/286 |
| 2023/0172358 | A1 * | 6/2023 | Xu | A47C 9/105 297/16.2 |
| 2023/0200539 | A1 * | 6/2023 | Chen | A47C 3/18 297/47 |

* cited by examiner

*Primary Examiner* — Rodney B White

(57) ABSTRACT

The present disclosure provides a swingable bracket for furniture including a base and multiple support members movably connected to the base; the base includes an upper base and a lower base; the multiple support members include three or more lower support members connected to the lower base and three or more upper support members connected to the upper base; the base further includes a deflection mechanism disposed between the upper base and the lower base, including a first portion connected to the lower base and a second portion connected to the upper base and pivotable relative to the first portion, a holding space is defined within the deflection mechanism, and the deflection mechanism further includes a resilient member disposed within the holding space for providing resistance when the second portion is deflected relative to the first portion.

9 Claims, 5 Drawing Sheets

SWINGABLE BRACKET FOR FURNITURE

CROSS REFERENCE

The present disclosure claims priority of Chinese Patent Application No. 202311214974.5, filed on Sep. 19, 2023, the entire contents of which are hereby incorporated by reference in their entirety.

TECHNICAL FIELD

The present disclosure relates to technical field of leisure goods, especially relates to a swingable bracket for furniture.

BACKGROUND

With the development of the economy, urban people often choose to go out of their homes to relax and enjoy the outdoor life.

For outdoor activities, such as fishing, camping, etc., portable tables and chairs and other furniture are usually required. However, the common portable tables and chairs only have the function of foldability, with a single way of use and lack of adaptability and interestingness to different needs.

SUMMARY OF THE DISCLOSURE

Based on this, it is necessary to propose a swingable bracket for furniture to solve the problem of using portable furniture in a single way.

The present disclosure provides a swingable bracket for furniture, including a base and a plurality of support members movably connected to the base; the base includes an upper base and a lower base; the plurality of support members include three or more lower support members connected to the lower base and three or more upper support members connected to the upper base; wherein the base further includes a deflection mechanism disposed between the upper base and the lower base; the deflection mechanism includes: a first portion connected to the lower base, and a second portion connected to the upper base and pivotable relative to the first portion; a holding space is defined within the deflection mechanism, and the deflection mechanism further includes a resilient member disposed within the holding space for providing resistance when the second portion is deflected relative to the first portion.

In some embodiments, the first portion and the second portion together enclose the holding space.

In some embodiments, the deflection mechanism further includes a third portion disposed between the first portion and the second portion, enclosing the holding space together with the first portion and the second portion.

In some embodiments, the deflection mechanism further includes a rotation shaft; the first portion includes a first rear wall horizontally arranged, a first front wall disposed opposite the first rear wall, a first inner wall disposed near the rotation shaft, and a first outer wall disposed opposite the first inner wall; the first rear wall, the first front wall, the first inner wall, and the first outer wall enclose a fan-shaped first receiving cavity.

In some embodiments, the second portion includes a second inner wall near the rotation shaft, a second outer wall disposed opposite the second inner wall, a second front wall and a second rear wall each connected to the second inner wall and the second outer wall; the second rear wall, the second front wall, the second inner wall, and the second outer wall enclose a fan-shaped second receiving cavity.

In some embodiments, the resilient member includes: a front end disposed in the first front wall or the second front wall, and a rear end disposed in the first rear wall or the second rear wall.

In some embodiments, the resilient member is a spring, and a width of the holding space is the same as a diameter of the spring.

In some embodiments, the first portion defines a limit slot below the second rear wall.

In some embodiments, the first portion further includes a limit portion arranged on a side of the rotation shaft back from the limit slot and projecting toward the upper base.

In some embodiments, the upper base defines an opening towards the lower base, and the second portion is at least partially received in the opening.

The swingable bracket for furniture provided by the present disclosure includes a base and multiple support members movably connected to the base; the base includes an upper base and a lower base; the multiple support members include three or more lower support members connected to the lower base and three or more upper support members connected to the upper base; the base further includes a deflection mechanism disposed between the upper base and the lower base, including a first portion connected to the lower base and a second portion connected to the upper base and pivotable relative to the first portion, a holding space is defined within the deflection mechanism, and the deflection mechanism further includes a resilient member disposed within the holding space for providing resistance when the second portion is deflected relative to the first portion. Using the deflection mechanism having the first portion and the second portion pivotable relative to the first portion, the swingable bracket for furniture provided by the present disclosure can be swung stably, improving the comfort and interestingness of portable furniture arranged with the bracket.

BRIEF DESCRIPTION OF THE DRAWINGS

In order to more clearly illustrate the technical solutions in the specific embodiments or related art of the present disclosure, the accompanying drawings to be used in the description of the specific embodiments or related art will be briefly introduced below. It will be obvious that the accompanying drawings in the following description are some of the embodiments of the present disclosure, and that for those skilled in the art, other attachments can be obtained based on these accompanying drawings without putting in creative labor.

DETAILED DESCRIPTION

Figure 1:
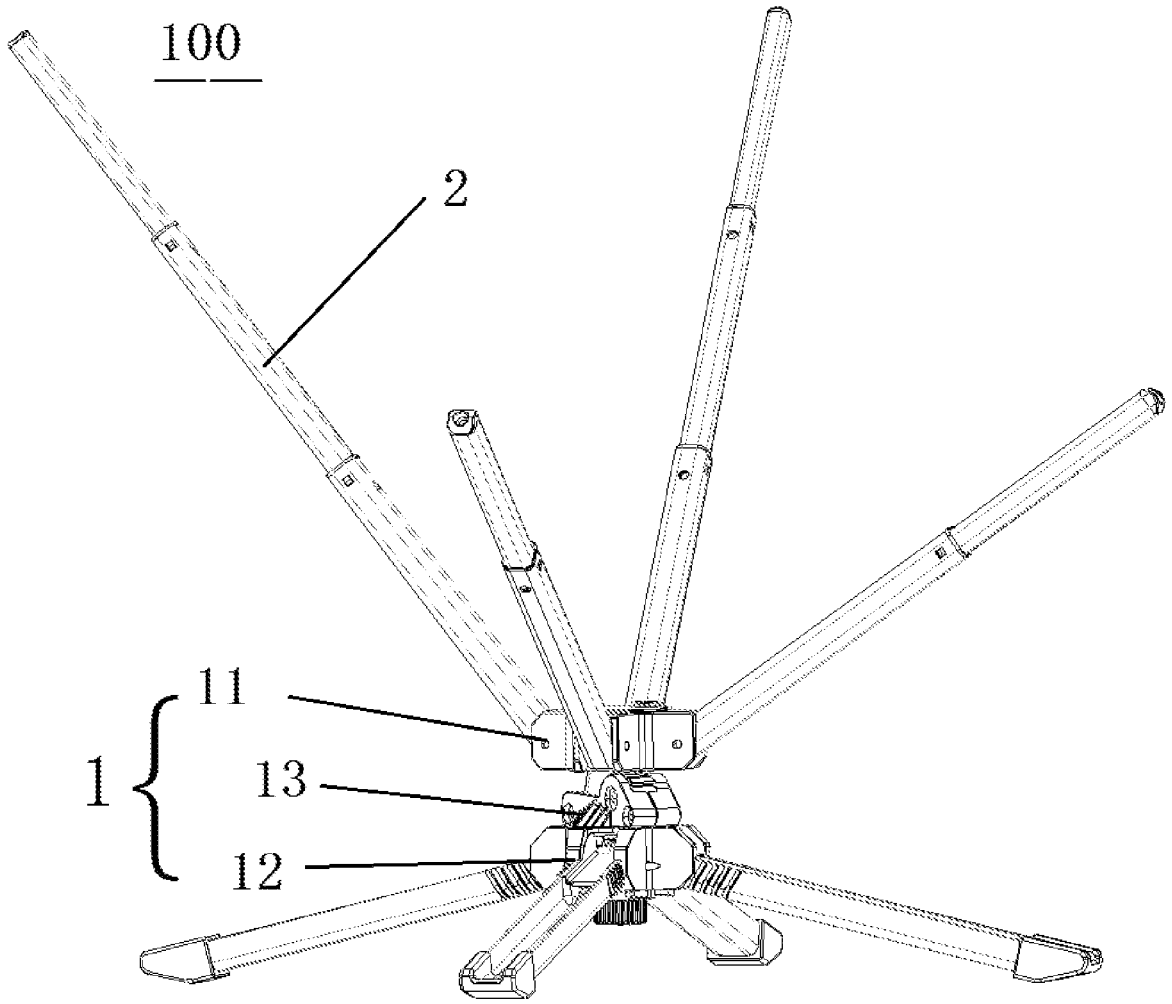
FIG. 1 is an assembled structural schematic view of a swingable bracket for furniture according to an embodiment of the present disclosure.
Figure 2:
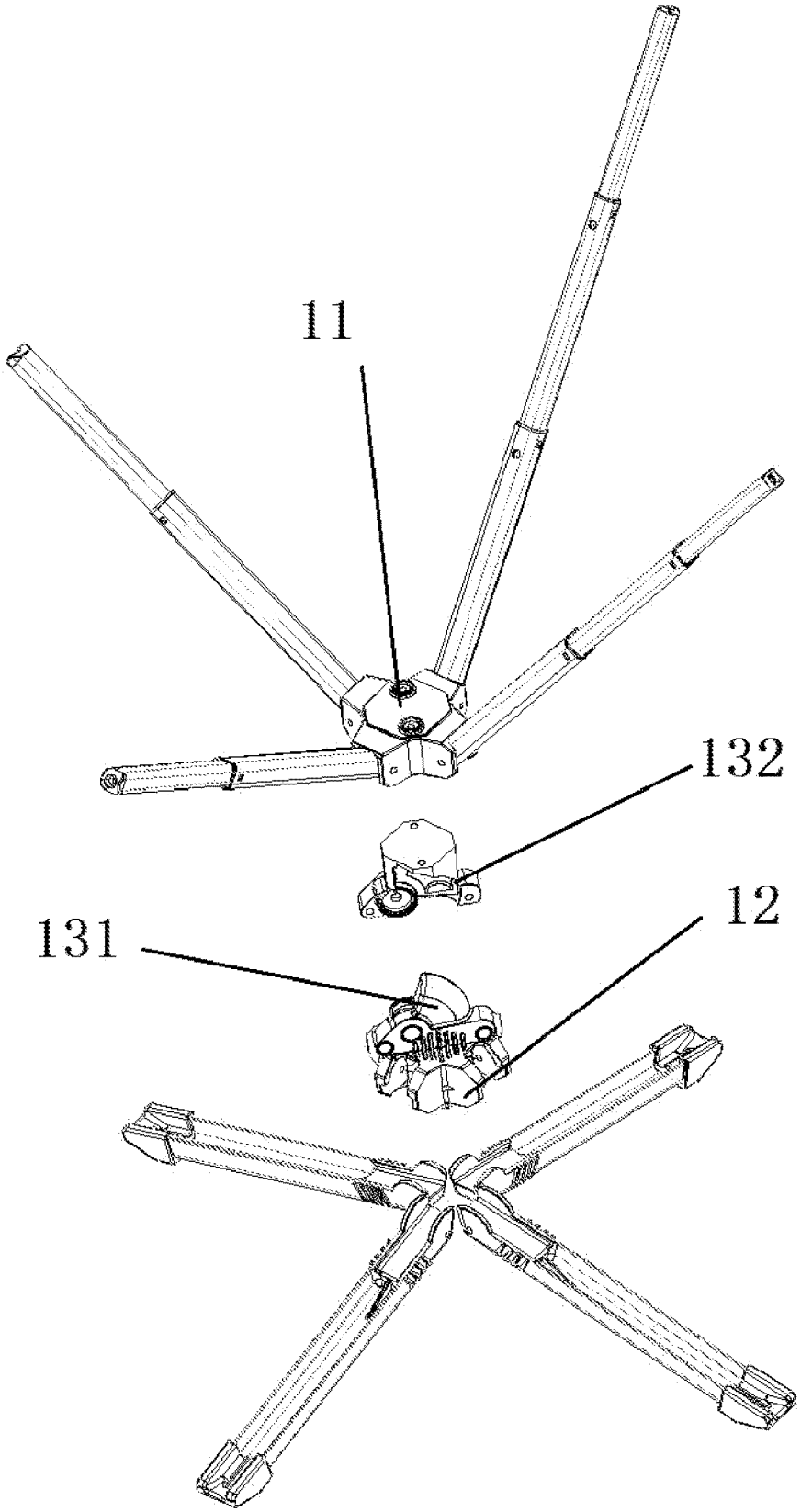
FIG. 2 is a disassembled structural schematic view of a swingable bracket for furniture according to an embodiment of the present disclosure.

The following will be a clear and complete description of the technical solutions in the embodiments of the present disclosure in conjunction with the accompanying drawings in the embodiments of the present disclosure. Obviously, the described embodiments are only a part of the embodiments of the present disclosure, and not all of them. Based on the embodiments in the present disclosure, all other embodiments obtained by those skilled in the art without creative labor fall within the scope of the present disclosure.

In the description of the present disclosure, it is noted that when the terms "center", "up", "down", "left", "right", "vertical", "horizontal", "inner", "outer", etc. appear, they are indicative of an orientation or positional relationship based on that shown in the accompanying drawings, which is intended only to facilitate and simplify the description of the present disclosure and is not indicative of, or suggestive of, the necessity for the device or element referred to to be of a particular orientation, or to be constructed and operated in a particular orientation, and therefore is not to be construed as a limitation of the present disclosure. Furthermore, the terms "first", "second", "third", if present, are used for descriptive purposes only and are not to be understood as indicating or implying relative importance.

Referring to FIGS. 1-FIG. 5, the present disclosure provides a swingable bracket 100 for furniture, including a base 1 and multiple support members 2 movably connected to the base 1; the base 1 includes a lower base 11 and an upper base 12; the multiple support members 2 include three or more lower support members 21 connected to the lower base 11 and three or more upper support members 21 connected to the upper base 11; the base 1 further includes a deflection mechanism 13 disposed between the upper base 11 and the lower base 12, the deflection mechanism 13 including a first portion 131 connected to the lower base 12 and a second portion 132 connected to the upper base 11 and pivotable relative to the first portion 131. A holding space 130 is defined within the deflection mechanism 13, and in the embodiments, the first portion 131 and the second portion 132 together enclose the holding space 130. The deflection mechanism 13 further includes a resilient member 133 disposed within the holding space 130 for providing resistance when the second portion 132 is deflected relative to the first portion 131.

Specifically, the deflection mechanism 13 includes a rotation shaft 1300; the first portion 131 includes a first rear wall 1311 horizontally arranged, a first front wall 1312 disposed opposite the first rear wall 1311, a first inner wall 1313 disposed near the rotation shaft 1300, and a first outer wall 1314 disposed opposite the first inner wall 1313; the first rear wall 1311, the first front wall 1312, the first inner wall 1313, and the first outer wall 1314 enclose a fan-shaped first receiving cavity 1310.

The second portion 132 includes a second inner wall 1323 near the rotation shaft 1300, a second outer wall 1324 disposed opposite the second inner wall 1323, a second front wall 1322 and a second rear wall 1321 each connected to the second inner wall 1323 and the second outer wall 1324; the second rear wall 1321, the second front wall 1322, the second inner wall 1323, and the second outer wall 1324 enclose a fan-shaped second receiving cavity 1320.

Figure 3:
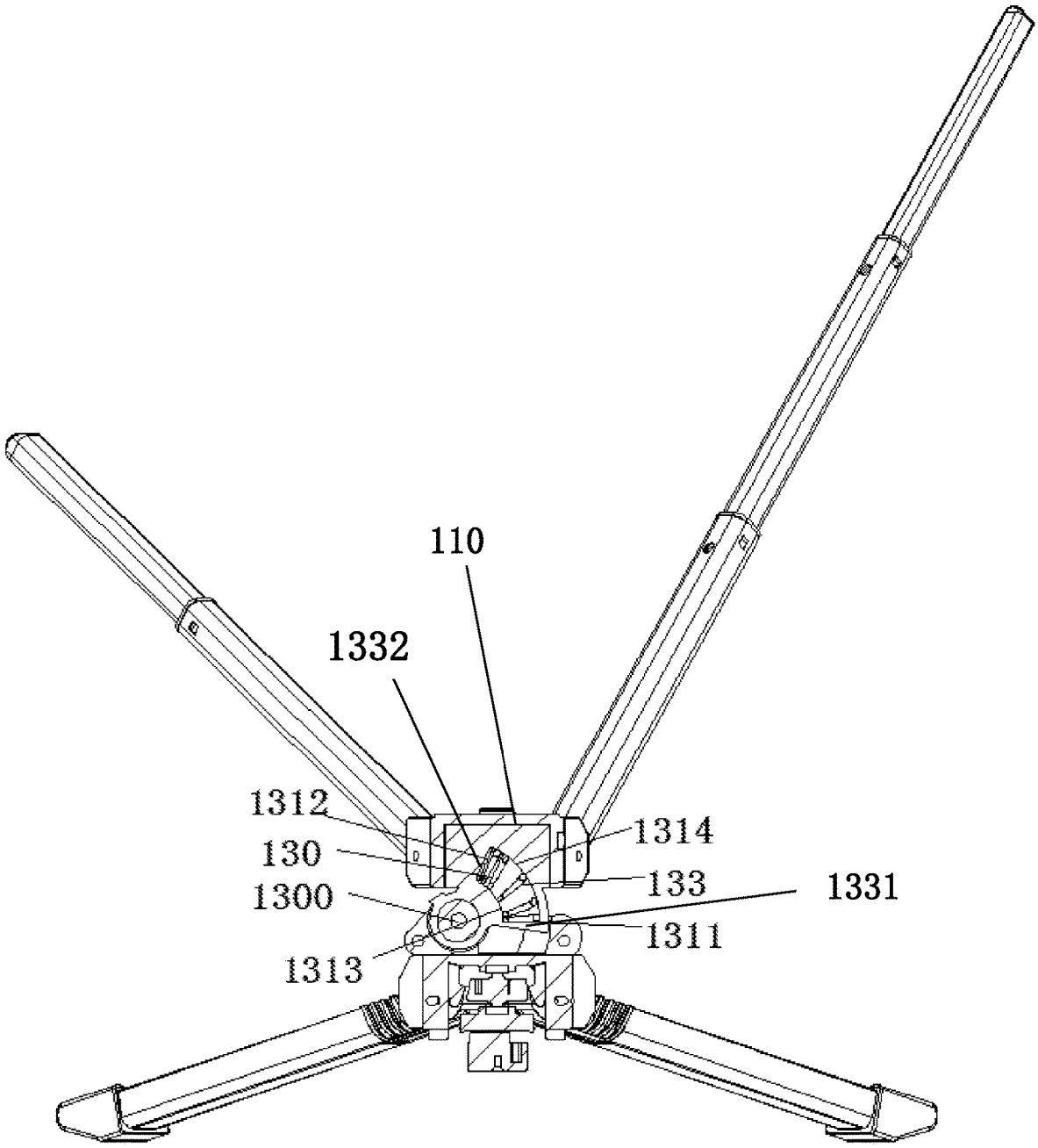
FIG. 3 is a cross-sectional view of a base of a swingable bracket for furniture in an unloaded state according to an embodiment of the present disclosure.
Figure 4:
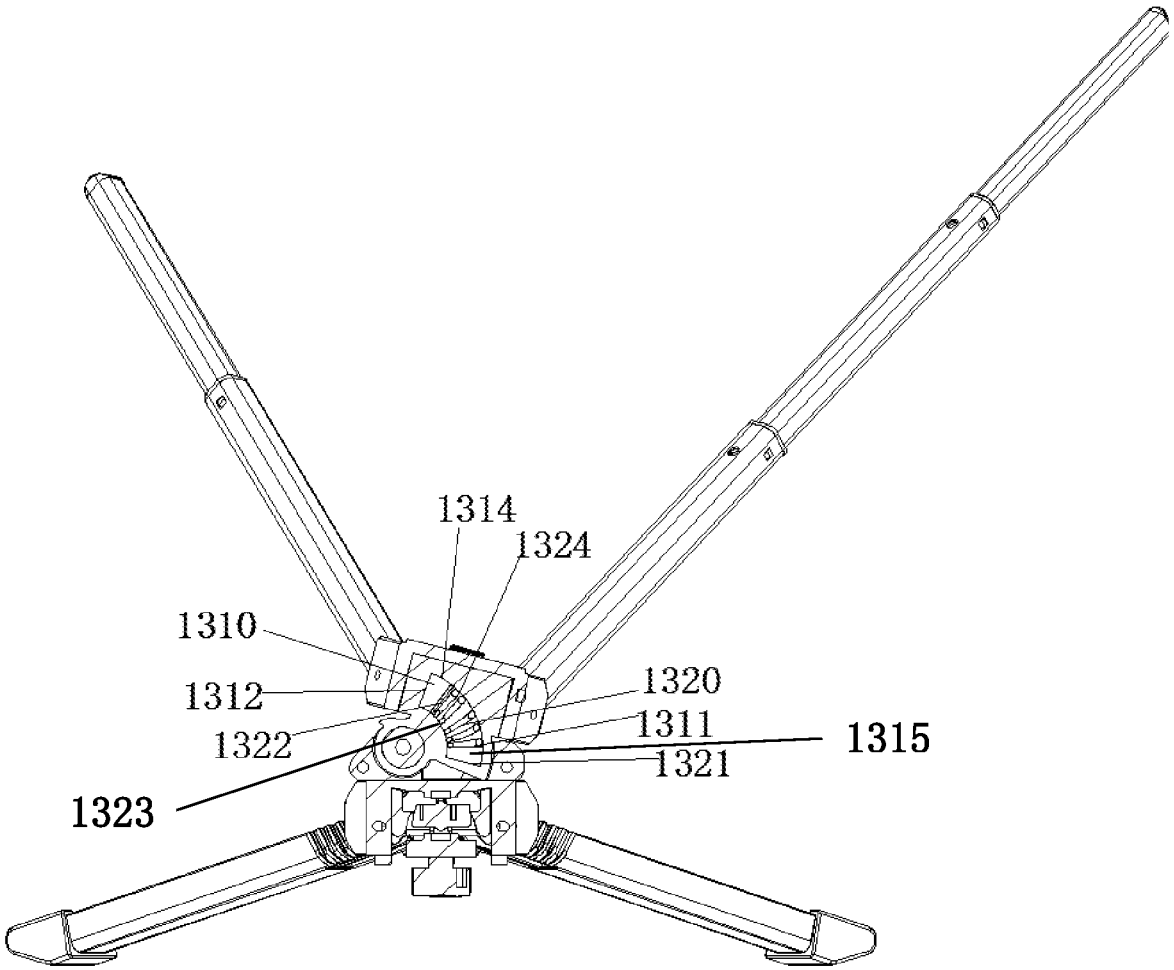
FIG. 4 is a cross-sectional view of a base of a swingable bracket for furniture in a forward-swinging state according to an embodiment of the present disclosure.
Figure 5:
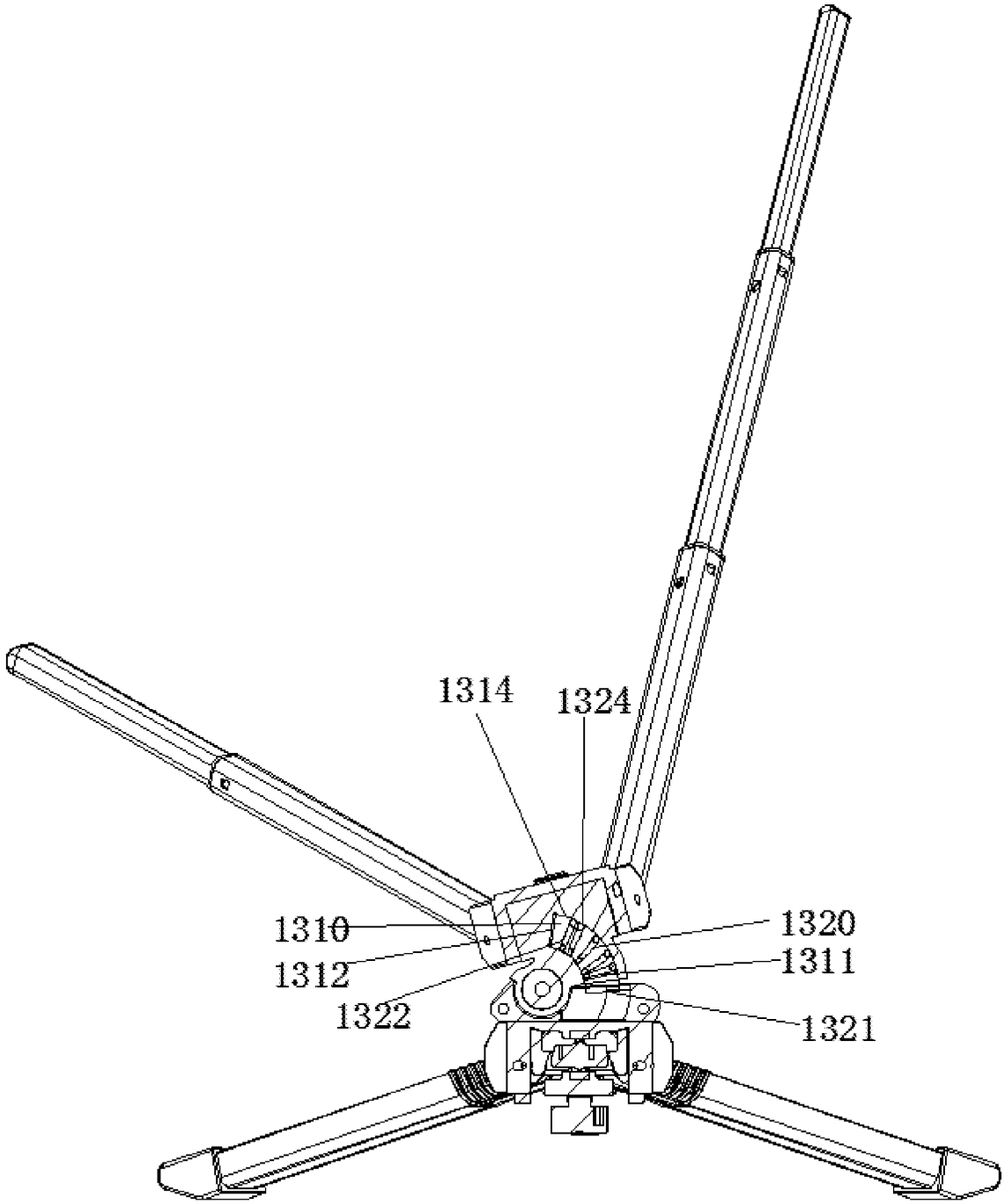
FIG. 5 is a cross-sectional view of a base of a swingable bracket for furniture in a backward-swinging state according to an embodiment of the present disclosure.

The resilient member 133 includes a front end 1332 disposed in the first front wall 1312 or the second front wall 1322 and a rear end 1331 disposed in the first rear wall 1311 or the second rear wall 1321. Specifically, as shown in FIG. 3, when the swingable bracket 100 is in an unloaded state, the front end 1332 of the resilient member 133 abuts against both the first front wall 1312 and the second front wall 1322, the rear end 1331 of the resilient member 133 abuts against both the first rear wall 1311 and the second rear wall 1321. As shown in FIG. 4, when the swingable bracket 100 is in a forward-swinging state, the first portion 131 remains stationary, and the second rear wall 1321 of the second portion 132 moves toward the first front wall 1312 of the first portion 131, such that the second front wall 1322 of the second portion 132 is staggered from the first front wall 1312 of the first portion 131 and the second rear wall 1321 of the second portion 132 is staggered from the first rear wall 1311 of the first portion 131. In this case, the front end 1332 of the resilient member 133 abuts against the first front wall 1312 and the rear end 1331 of the resilient member 133 abuts against the second rear wall 1321. In this way, the resilient member 133 is compressed to provide resistance to deflection of the second portion 132 relative to the first portion 131. As shown in FIG. 5, when the swingable bracket 100 is in a backward-swinging state, the first portion 131 remains stationary, and the front wall 1322 of the second portion 132 moves toward the first rear wall 1311 of the first portion 131. In this case, the front end 1332 of the resilient member 133 abuts against the second front wall 1322, and the rear end 1331 of the resilient member 133 abuts against the first rear wall 1311. In this way, the resilient member 133 is compressed to provide resistance to deflection of the second portion 132 relative to the first portion 131.

In the embodiments, the resilient member 133 may be a spring, and the first receiving cavity 1310 and the second receiving cavity 1320 together define the holding space 130. A width of the holding space 1300 is the same as a diameter of the spring 133, such that the spring 133 does not offset when the second portion 132 is deflected relative to the first portion 131.

In other embodiments, the deflection mechanism may further include a third portion disposed between the first portion and the second portion, enclosing the holding space together with the first portion and the second portion, which may prevent the problem of the spring getting stuck when the first portion and the second portion move.

In some embodiments, the first portion 131 defines a limit slot 1315 below the second rear wall 1321. When the swingable bracket 100 is in the backward-swinging state, the second rear wall 1321 of the second portion 132 enters into the limit slot 1315. Further, the first portion 131 includes a limit portion 1316 arranged on a side of the rotation shaft 1300 back from the limit slot 1315 and projecting toward the upper base 11. When the swingable bracket 100 is in the forward-swinging state, the limiting portion 1316 is configured to limit the rotation angle of the second portion 132 to prevent the swingable bracket 100 from tipping over.

In the embodiment, the upper base 11 defines an opening 110 towards the lower base 12, and the second portion 132 is at least partially received in the opening 110, driving the upper base 11 to be deflected together relative to the first portion 131, so as to realize that the lower base 12 does not move, and the upper base 11 swings relative to the lower base 12.

The swingable bracket for furniture provided by the present disclosure includes a base and multiple support members movably connected to the base; the base includes an upper base and a lower base; the multiple support members include three or more lower support members connected to the lower base and three or more upper support members connected to the upper base; the base further includes a deflection mechanism disposed between the upper base and the lower base, including a first portion connected to the lower base and a second portion connected to the upper base and pivotable relative to the first portion, a holding space is defined within the deflection mechanism, and the deflection mechanism further includes a resilient member disposed within the holding space for providing resistance when the second portion is deflected relative to the first portion. Using the deflection mechanism having the first portion and the second portion pivotable relative to the first portion, the swingable bracket for furniture provided by the present disclosure can be swung stably, improving the comfort and interestingness of portable furniture arranged with the bracket.

The above embodiments are only intended to illustrate the technical solution of the present disclosure, not to limit it; although the present disclosure has been described in detail with reference to the foregoing embodiments, those skilled in the art should understand that it is still possible to modify the technical solution recorded in the foregoing embodiments, or to replace some or all of the technical features with equivalent ones; and these modifications or replacements do not make the corresponding technical solution deviate from the essence of the technical solution of the present disclosure.

What is claimed is:

1. A swingable bracket for furniture, comprising a base and a plurality of support members movably connected to the base; wherein the base comprises an upper base and a lower base; the plurality of support members comprise three or more lower support members connected to the lower base and three or more upper support members connected to the upper base;

wherein the base further comprises a deflection mechanism disposed between the upper base and the lower base; the deflection mechanism comprises: a first portion connected to the lower base, and a second portion connected to the upper base and pivotable relative to the first portion; a holding space is defined within the deflection mechanism, and the deflection mechanism further comprises a resilient member disposed within the holding space for providing resistance when the second portion is deflected relative to the first portion;

wherein the deflection mechanism further comprises a rotation shaft; the first portion comprises a first rear wall horizontally arranged, a first front wall disposed opposite the first rear wall, a first inner wall disposed near the rotation shaft, and a first outer wall disposed opposite the first inner wall; the first rear wall, the first front wall, the first inner wall, and the first outer wall enclose a fan-shaped first receiving cavity.

2. The swingable bracket for furniture according to claim 1, wherein the first portion and the second portion together enclose the holding space.

3. The swingable bracket for furniture according to claim 1, wherein the deflection mechanism further comprises a third portion disposed between the first portion and the second portion, enclosing the holding space together with the first portion and the second portion.

4. The swingable bracket for furniture according to claim 1, wherein the second portion comprises a second inner wall near the rotation shaft, a second outer wall disposed opposite the second inner wall, a second front wall and a second rear wall each connected to the second inner wall and the second outer wall; the second rear wall, the second front wall, the second inner wall, and the second outer wall enclose a fan-shaped second receiving cavity.

5. The swingable bracket for furniture according to claim 4, wherein the resilient member comprises: a front end disposed in the first front wall or the second front wall, and a rear end disposed in the first rear wall or the second rear wall.

6. The swingable bracket for furniture according to claim 5, wherein the resilient member is a spring, and a width of the holding space is the same as a diameter of the spring.

7. The swingable bracket for furniture according to claim 4, wherein the first portion defines a limit slot below the second rear wall.

8. The swingable bracket for furniture according to claim 7, wherein the first portion further comprises a limit portion arranged on a side of the rotation shaft back from the limit slot and projecting toward the upper base.

9. The swingable bracket for furniture according to claim 1, wherein the upper base defines an opening towards the lower base, and the second portion is at least partially received in the opening.

* * * * *